US008807121B2

(12) United States Patent
Ikeya

(10) Patent No.: US 8,807,121 B2
(45) **Date of Patent: *Aug. 19, 2014**

(54) PRESSURE CONTROL DEVICE

(75) Inventor: Masaki Ikeya, Obu (JP)

(73) Assignee: Aisan Kogyo Kabushiki Kaisha, Obu-Shi, Aichi-Ken (JP)

( * ) Notice: Subject to any disclaimer, the term of this patent is extended or adjusted under 35 U.S.C. 154(b) by 788 days.

This patent is subject to a terminal disclaimer.

(21) Appl. No.: 12/968,325

(22) Filed: Dec. 15, 2010

(65) Prior Publication Data

US 2011/0139127 A1 Jun. 16, 2011

(30) Foreign Application Priority Data

Dec. 16, 2009 (JP) ..... 2009-285190

(51) Int. Cl.
*F02M 37/04* (2006.01)

(52) U.S. Cl.
USPC ..... 123/506; 123/457; 123/510

(58) Field of Classification Search
USPC ..... 123/506, 510, 511, 514, 457, 459, 465, 123/447, 468
See application file for complete search history.

(56) References Cited

U.S. PATENT DOCUMENTS

| | | | | |
|---|---|---|---|---|
| 4,409,931 | A * | 10/1983 | Lindberg | 123/25 R |
| 4,782,794 | A * | 11/1988 | Hsu et al. | 123/23 |
| 4,829,964 | A | 5/1989 | Asayama | |
| 7,878,179 | B2 | 2/2011 | Ikeya | |
| 2009/0151703 | A1* | 6/2009 | Ikeya | 123/506 |

FOREIGN PATENT DOCUMENTS

| | | | |
|---|---|---|---|
| DE | 102008052700 | A1 | 4/2009 |
| EP | 2450559 | A1 | 9/2013 |
| JP | 61-108834 | | 5/1986 |
| JP | 2009-108684 | A | 5/2009 |
| JP | 2009-144686 | | 7/2009 |

OTHER PUBLICATIONS

Office Action dated Mar. 19, 2013 for Application No. 2009-285190.
Espacenet English abstract of JP 2009-108684 A.
German Office Action dated May 28, 2014, corresponding to German Patent Application No. 102010054765.4; with English translation attached.

* cited by examiner

*Primary Examiner* — John Kwon
(74) *Attorney, Agent, or Firm* — Ladas & Parry LLP

(57) ABSTRACT

A pressure control device controls a pressure of fuel supplied from a fuel tank to an engine via a fuel pump. The pressure control device includes a valve device, a first force-applying device and a second force-applying device. The valve device is provided in a path of the fuel from the fuel pump to the engine and comprising a valve and a spring. The valve is movable in an opening direction and a closing direction for permitting and preventing flow of the fuel from the fuel pump to the engine, respectively. The spring applies a first force to the valve in the closing direction. The first force-applying device is operable to apply a second force to the valve in the opening direction depending on the pressure of the fuel supplied from the fuel pump. The second force-applying device is operable to apply a third force to the valve in the opening direction independently of the second force applied by the first force-applying device or independently of the pressure of the fuel used for the first force-applying device.

20 Claims, 12 Drawing Sheets

PRESSURE CONTROL DEVICE

This application claims priority to Japanese patent application serial number 2009-285190 the contents of which are incorporated herein by reference.

BACKGROUND OF THE INVENTION

1. Field of the Invention

The present invention relates to a pressure control device for regulating the pressure of fuel supplied from a fuel tank to an engine.

2. Description of the Related Art

In two-wheeled or four-wheeled automobiles, when fuel is supplied from a fuel tank to an engine, a pressure adjustment is made so that the fuel may be supplied under an appropriate pressure. Hereinafter, this pressure adjustment will be referred to as "pressure regulation". That is, the fuel supply system is provided with a pressure control device for regulating the supplied fuel to an appropriate pressure.

As disclosed in Japanese Laid-Open Patent Publication No. 2009-144686, a known pressure control device is equipped with a seat, a valve seated on the seat to close a supply flow path, and a biasing spring biasing the valve in a seating direction for seating on the seat. The pressure control device disclosed in the Publication No. 2009-144686 utilizes a pressurizing force of the supply fuel fed from a fuel pump, and a back pressure after having fed this supply fuel, whereby the seated state of the valve with respect to the seat is adjusted, and the pressure of the supply fuel is regulated.

In recent years, to achieve an improvement in terms of the starting property of the engine, there is a need that the fuel pressure in the fuel supply path toward the engine be maintained in a high pressure state even in a state in which the fuel pump is not operating.

However, in a pressure control device in the state in which the fuel pump is not operating, the seating of the valve on the seat is likely to be released, resulting in the system being subject to leakage of fuel from the fuel supply path. If fuel leaks from the fuel supply path, it is impossible to maintain the fuel in the fuel supply path in a high pressure state, making it impossible to meet the above-mentioned need.

Therefore, there is a need in the art for a pressure control device that can maintain a fuel pressure within a fuel supply path for supplying fuel to an engine even in a state in which a fuel pump is not operating

SUMMARY OF THE INVENTION

A pressure control device controls a pressure of fuel supplied from a fuel tank to an engine via a fuel pump. The pressure control device includes a valve device, a first force-applying device and a second force-applying device. The valve device is provided in a path of the fuel from the fuel pump to the engine and comprising a valve and a spring. The valve is movable in an opening direction and a closing direction for permitting and preventing flow of the fuel from the fuel pump to the engine, respectively. The spring applies a first force to the valve in the closing direction. The first force-applying device is operable to apply a second force to the valve in the opening direction depending on the pressure of the fuel supplied from the fuel pump. The second force-applying device is operable to apply a third force to the valve in the opening direction independently of the second force applied by the first force-applying device or independently of the pressure of the fuel used for the first force-applying device.

DETAILED DESCRIPTION OF THE INVENTION

Figure 1:
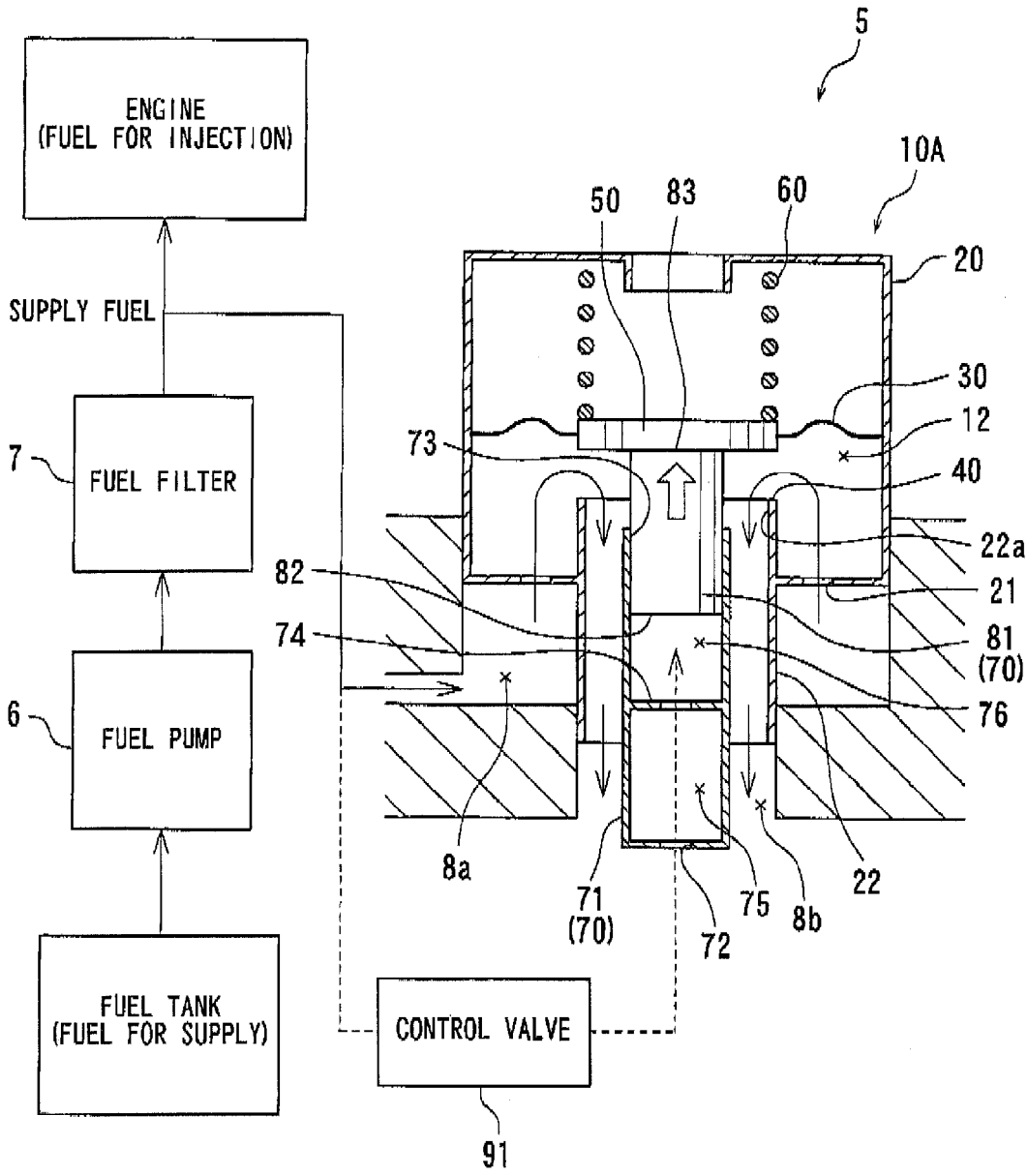
FIG. 1 is a schematic sectional view of a pressure control device according to a first embodiment.

Each of the additional features and teachings disclosed above and below may be utilized separately or in conjunction with other features and teachings to provide improved pressure control devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a pressure control device for controlling a pressure of fuel supplied from a fuel tank to an engine via a fuel pump includes a fuel storage chamber capable of storing fuel pressurized by the fuel pump, a valve seat provided at an outflow port of the fuel storage chamber, from which the fuel stored in the fuel storage chamber outflows, and a valve movable in a first direction toward the valve seat and a second direction away from the valve seat. The valve can close the outflow port when the valve is seated on the valve seat, and the valve can open the outflow port when the valve is positioned away from the valve seat. The control device further includes a biasing spring applying a first force to the valve in the first direction, a valve opening device applying a second force to the valve in the second direction based on a pressure of the fuel stored in the fuel storage chamber, and a pressure load applying device applying a third force to the valve in the second direction. A pressure of the fuel supplied to the engine is controlled based on the relationship between the first, second and third forces.

For example, the pressure of the first, second and third forces may be determined such that (a) when a pressure within the fuel storage chamber is lower than a first predetermined pressure, the valve is seated on the valve seat by the first force, so that the fuel within the fuel storage chamber does not outflow from the fuel storage chamber, (b) when the pressure within the fuel storage chamber is equal to or higher than the first predetermined pressure, the valve is positioned away from the valve seat by the second force against the first force, and (c) when the pressure within the fuel storage chamber is a second predetermined pressure lower than the first predetermined pressure, the third force can be applied to the valve, so that the valve is positioned away from the valve seat by the sum of the second force and the third force against the first force.

Therefore, in order to close the outflow port by the biasing valve for preventing the fuel from flowing out of the outflow port by the valve, it is possible to use only the biasing force of the biasing spring. Therefore, it is possible to use a spring having a large biasing force as the biasing spring, so that the valve can be firmly seated on the valve seat. As a result, when the fuel pump is not operating, it is possible to maintain the fuel within a supply path to the engine at a high pressure.

The pressure load applying device may include a pressure accumulating chamber that can accumulate a pressure for application to the valve. Therefore, unlike the case of the supply fuel stored in the fuel storage chamber, the fuel accumulated in the pressure accumulating chamber can exert a pressure load to the valve while the fuel being maintained at a predetermined pressure level without causing outflow. As a result, the pressure load built up by the pressure load application device to be applied to the valve can be maintained in stable. Thus, it is possible, for example, to reduce the pressure for building up this pressure load, i.e., the pump load of the fuel pump, etc., and to reduce the energy consumed the fuel pump (fuel consumption). That is, it is possible to reduce the general fuel consumption to thereby achieve an improvement in terms of fuel consumption.

The pressure load applying device may further include a plunger capable acting on the valve, and the pressure accumulated within the pressure accumulating chamber is applied to the valve via the plunger.

Therefore, leak whether the action force due to the pressure load application device is necessary or unnecessary, it is possible to cause the pressure accumulated in the pressure accumulating chamber to be applied to the valve without causing leakage of the fuel. As a result, even if, for example, the action force due to the pressure load application device is not necessary, due to the incorporation of the plunger, it is possible to minimize the leakage of pressure from the pressure accumulating chamber.

The plunger may have a contact area for contacting the valve and a pressure receiving area for receiving the pressure of the pressure accumulating chamber. The pressure receiving area is larger than the contact area. With this difference in the area, it is possible to accurately control the movement of the plunger, so that it is possible to easily perform the control of the pressure within the pressure storage chamber for applying the force to the valve by the plunger. In addition, it is possible to secure a large pressure receiving area for receiving the pressure of the supply fuel stored in the fuel storage chamber. As a result, the pressure of the supply fuel stored in the fuel storage chamber can be easily received, making it possible to achieve enhancement in sensitivity to changes in the pressure of the supply fuel.

In another example, the pressure accumulating chamber includes an expandable portion that can expand by the pressure accumulated within the pressure accumulating chamber for applying the third force to the valve. Therefore, there is no need to provide a separate member other than the pressure accumulating member. As a result, when an action force due to the pressure accumulated in the pressure accumulating chamber is applied to the valve, it is possible to reliably prevent leakage of the pressure accumulated in the pressure accumulating chamber. That is, in building up the pressure load to be applied to the valve, it is possible to avoid loss of load and eventually to effectively reduce the pump load of the pressurization pump.

The pressure accumulating chamber may accumulate a pressure of the fuel pressurized by the fuel pump. With this arrangement, in accumulating pressure in the pressure accumulating chamber, there is no need to separately provide a pressurization pump. As a result, it is possible to reduce the number of pressurization pumps and to eventually reduce the fuel consumption.

Examples will now be described with reference to the drawings.

FIRST EXAMPLE

First, a pressure control device 10A according to a first example will be described. FIG. 1 is a schematic sectional view of the pressure control device 10A of the first embodiment. The schematic sectional view of the pressure control device 10A shown in FIG. 1 as well as the schematic sectional views of the other examples described below (except for the operation diagrams) show the state where an outflow port 22*a* is open (the valve open state) when the pressure of the supply fuel is regulated.

In two-wheeled and four-wheeled automobiles, fuel is supplied from a fuel tank to an engine. For the supply of the fuel, there is utilized a fuel supply system 5 as shown in FIG. 1. The fuel supply system 5 is equipped with a fuel pump 6 pressurizing and feeding fuel stored in a fuel tank (hereinafter called "supply fuel"), a fuel filter 7 filtering the supply fuel fed from the fuel pump 6, and the pressure control device 10A regulating the pressure of the supply fuel after being filtered. The fuel supply system 5, constructed as described above, supplies the supply fuel stored in the fuel tank to the engine therefrom so as to be injected from an injector(s) of the engine fuel (hereinafter called "injection fuel").

The pressure control device 10A provided in the fuel supply system 5 can regulate the pressure of the supply fuel supplied to the engine from the fuel tank. That is, a part of the supply fuel pressurized and filtered as described above is fed to the pressure control device 10A for pressure regulation. As shown in FIG. 1, the pressure control device 10A generally includes a housing 20 and a valve device provided inside the housing 20. The housing 20 is formed to have a substantially box-shaped hollow structure so that the valve device can be provided therein. The housing 20 is formed so as to allow the supply fuel to flow into and out of it so that pressure regulation may be effected by the valve device within the housing 20 as described below. More specifically, the housing 20 is equipped with a plurality of inflow ports 21 and an outflow port 22*a*. The inlet ports 21 are spaced from each other in the circumferential direction of the housing 20. The supply fuel can enter the interior of the housing 20 from the exterior of the housing 20 through the inlet ports 21. The supply fuel can flow from the interior of the housing 20 to the exterior of the housing 20 through the outflow port 22*a*. The supply fuel entering the interior of the housing 20 from the inflow ports 21 and undergoing pressure regulation by the valve device internally provided flows out of the outflow port 22*a* when it becomes necessary for the fuel to flow to the exterior of the housing 20.

The inflow ports 21 and the outflow port 22*a* are disposed at the same side wall (lower wall as viewed in FIG. 1) of the housing 20. Thus, the supply fuel having entered from the inflow ports 21 flows along a U-shaped path as it flows out of the outflow port 22*a*.

More specifically, the inflow ports 21 are formed so as to extend through the side wall (lower wall) of the housing 20. As described above, the inflow ports 21 are formed so that a part of the pressurized and filtered supply fuel may flow into the housing 20. For this purpose, the inflow ports 21 communicate with a supply fuel path 8*a* for supplying a part of the pressurized and filtered supply fuel. In contrast, the outflow port 22*a* is formed by a tubular portion 22 fitted into the same side wall (lower wall) of the housing 20 where the inflow ports 21 are provided. The tubular portion 22 is formed as a substantially cylindrical tube opened at opposite ends (upper and lower ends as viewed in FIG. 1). When the tubular portion 22 is fitted into the housing 20, the housing inner end side thereof serves as the inflow port 22*a*, and the housing outer end side thereof serves as a discharge port 22*b*. The discharge port 22*b* of the tubular portion 22 communicates with a discharge fuel path 8*b* for discharging the supply fuel. The outflow port 22*a* serves to cause the supply fuel stored in a fuel storage chamber 12 described later to flow out.

Next, the valve device provided inside the housing 20 will be described. As shown in FIG. 1, the valve device generally includes a diaphragm 30, a seat 40, a valve 50, a biasing spring 60, and a pressure load applying device 70. In the following, these components will be described in detail.

The diaphragm 30 is formed of a thin resin plate capable of flexing when a pressure is applied. As shown in FIG. 1, the diaphragm 30 is provided so as to extend toward the center of the interior of the housing 20 from an intermediate portion of a side wall of the housing 20, which extends in a direction crossing the side wall of the housing 20 where the inflow ports 21 and the outflow port 22*a* are provided. More specifically, the outer peripheral end edge of the diaphragm 30 is connected with the inner wall surface of the housing 20, and the inner peripheral end edge thereof is connected with the outer periphery of the valve 50. Further, the diaphragm 30 divides the interior of the housing 20, and, through the division of the interior of the housing 20, the fuel storage chamber 12 is formed inside the housing 20. The fuel storage chamber 12 serves as a space where the supply fuel is stored when a part of the pressurized and filtered supply fuel is supplied from the inflow ports 21 as described above.

The seat 40 is a portion where the valve 50 is seated. The seat 40 is formed by the opening end edge of the outflow port 22*a* adjacent to the fuel storage chamber 12 described above.

The valve 50 is provided such that the outer peripheral portion thereof is connected with the inner peripheral end edge of the diaphragm 30, so that the valve 50 can be seated on and separated from the seat 40. More specifically, unlike the diaphragm 30 described above, the valve 50 is formed of a thick resin plate. The valve 50 is arranged so as to be supported by the diaphragm 30 at an arrangement position where it does not receive the pressure of the fuel stored in the fuel storage chamber 12. Thus, the valve 50 is movable by the diaphragm flexing under the pressure of the fuel stored in the fuel storage chamber 12 so as to be situated at either of two positions; i.e., a seated position where it is in contact with the seat 40 and a separated position where it is spaced apart from the seat 40. In the case where the valve 50 is seated on the seat 40, the outflow port 22*a* is closed (the outflow-port-closing state), and the supply fuel stored in the fuel storage chamber 12 is prevented from flowing out of the outflow port 22*a*. In contrast, in the case where the valve 50 is spaced apart from the seat 40, the outflow port 22*a* is opened (the outflow-port-opening state), and the supply fuel stored in the fuel storage chamber 12 is allowed to flow out of the outflow port 22*a*. In this way, the diaphragm 30 serves as valve opening device that causes the valve 50 to move away from the seat 40 by the pressure of the supply fuel stored in the fuel storage chamber 12.

The biasing spring 60 is arranged on the opposite side of the seat 40 with respect to the valve 50 mentioned above. One end of the biasing spring 60 is in engagement with the inner wall of the housing 20, and the other end thereof is in engagement with the valve 50. The biasing spring 60 engaged at both ends in this way can apply a spring load to the valve 50 so as to cause it to be seated on the seat 40. Normally, the spring 60*t* biases the valve 50 so as to cause it to be seated on the seat 40 so that the outflow port 22*a* may be firmly stopped. The diaphragm 30 can flex under the pressure of the supply fuel stored in the fuel storage chamber 12. When, as a result of this flexing of the diaphragm 30, the force acting on the valve 50 in a direction of separating it from the seat 40 becomes larger than the spring load of the biasing spring 60, the valve 50 moves to the separated position where it is spaced apart from the seat 40. Then, the outflow port 22*a* is brought to the open state, and the supply fuel stored in the fuel storage chamber 12 can flow out of the outflow port 22*a*.

Figure 2:
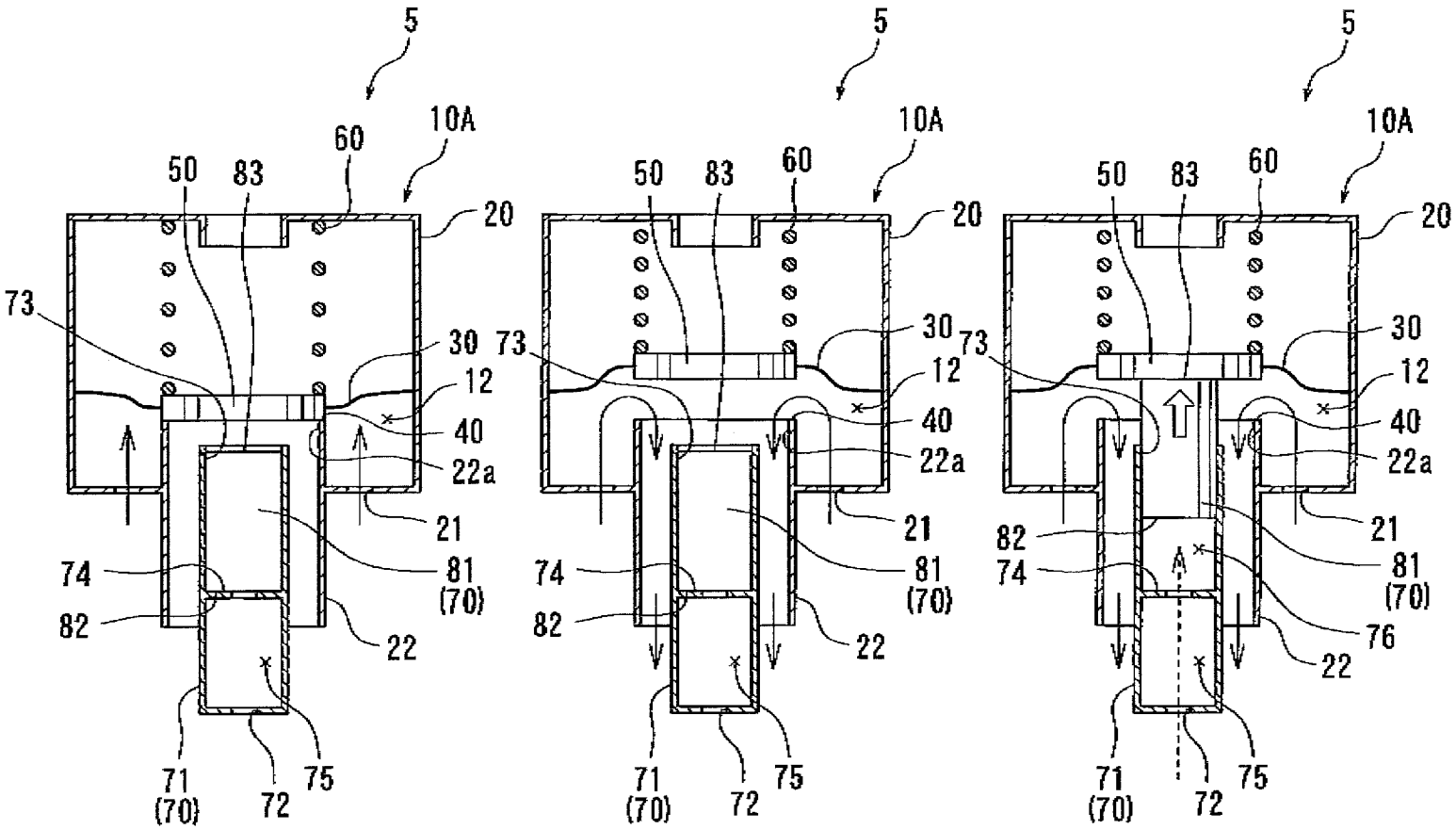
FIGS. 2A through 2C are schematic sectional views schematically illustrating the operation of the pressure control device shown in FIG. 1.

Next, the pressure load application device 70 will be described. FIGS. 2A through 2C are schematic sectional views illustrating the operation of the pressure control device 10A shown in FIG. 1. More specifically, FIG. 2A shows an outflow-port-closed state when the valve 50 is seated on the seat 40; FIG. 2B shows a first outflow-port-open state when the valve 50 is separated from the seat 40; and FIG. 2C shows a second outflow-port-open state when the valve 50 is separated from the seat 40.

The pressure load application device 70 applies a pressure load to the valve 50 in a direction opposite to that of the spring load of the biasing spring 60. That is, as shown in FIG. 1, etc., the pressure load application device 70 generally includes a pressure accumulating tubular portion 71, and a plunger 81.

The pressure accumulating tubular portion 71 is formed substantially in a cylindrical configuration and supported coaxially within the tubular portion 22. The pressure accumulating tubular portion 71 slidably accommodates the plunger 81 so as to allow it to move toward and away from the valve 50. On the exterior side (the lower side as seen in FIGS. 2A to 2C) with respect to the housing 20 of the pressure accumulating tubular portion 71, there is formed a supply side opening 72 allowing supply of the fuel to the interior from the exterior as described below. In contrast, on the interior side (the upper side as seen in FIGS. 2A to 2C) of the pressure accumulating tubular portion 71 where the valve 50 is arranged, there is formed a valve side opening 73 into which the plunger 81 can protrude for accommodation so as to be capable of moving toward and away from the valve 50. Further, at an intermediate portion of the interior of the pressure accumulating tabular portion 71, there is provided a stopper portion 74 limiting the separating movement of the plunger 81. The stopper portion 74 is formed as an inner flange, and defines a stroke end in the separating movement of the plunger 81 so as to secure a pressure accumulating chamber 75 described below. Thus, as shown in FIGS. 2A and 2B, the interior of the pressure accumulating tubular portion 71 at least between the stopper portion 74 and the supply side opening 72 is defined as the pressure accumulating chamber 75 into which the plunger 81 is not inserted. In contrast, the interior portion from the stopper portion 74 to the valve side opening 73 is defined as an accommodation chamber 76 capable of accommodating the plunger 81.

The pressure accumulating chamber 75 serves to accumulate a pressure exerting a pressure load applied to the valve 50. The pressure accumulating chamber 75 is defined between a bottom portion 82 of the plunger 81 and the supply side opening 72 of the pressure accumulating tubular portion 71. That is, as the capacity of the pressure accumulating chamber 75, the interior portion from the bottom portion 82 at the stopper portion 74 regulating position (coinciding with the stopper portion 74) where the plunger 81 is situated at the stroke end of the separating movement with respect to the valve 50 to the supply side opening 72 can provide a minimum capacity, and the capacity of the pressure accumulating chamber 75 may include an additional capacity provided by a part of the accommodation chamber 76 according to the relative position of the plunger 81 with respect to the pressure accumulating tubular portion 71. As shown in FIG. 2C, in the case where the plunger 81 contacts the valve 50 to cause the valve 50 to be separated from the seat 40 to bring the outflow port 22*a* into the open state, the capacity of the pressure accumulating chamber 75 becomes maximum. Here, in order to accumulate the pressure in the pressure accumulating chamber 75 for exerting a pressure load applied to the valve 50, the accumulation is effected, a portion of the supply fuel is fed to the fuel storage chamber 12 to the pressure accumulating chamber 75 as shown in FIG. 1. That is, the pressure of the supply fuel accumulated in the pressure accumulating chamber 75 utilizes the pressure of the supply fuel pressurized by the fuel pump 6 and filtered by the fuel filter 7, and the pressure of the supply fuel thus pressurized and filtered is controlled before being fed to the pressure accumulating chamber 75. To this end, in the flow path for supplying fuel to the pressure accumulating chamber 75, there is provided a control valve 91 for controlling the pressure of the supply fuel that is fed to the pressure accumulating chamber 75. The control valve 91 controls the flow rate of the supply fuel such that the supply fuel is fed to the pressure accumulating chamber 75 when the pressure of the supply fuel is within a predetermined range. Here, the pressure of the supply fuel whose flow rate will be hereinafter called a control pressure, and the flow of the supply fuel having the control pressure is indicated by a dashed arrow line in the drawings.

The plunger 81 can apply an action force on the valve 50 by receiving the pressure in the pressure accumulating chamber 75 so as to exert a pressure load on the valve 50 from the pressure accumulating chamber 75. The plunger 81 is formed to have a cylindrical configuration, and is arranged so as to be capable of moving toward and away from the valve 50 and capable of being accommodated in the accommodation chamber 76 of the pressure accumulating tubular portion 71. The end portion of the fuel supply side (the lower side as seen in FIGS. 2A to 2C) of the plunger 81 is configured as a bottom portion 82 and can contact the stopper portion 74 of the pressure accumulating tubular portion 71 when the plunger 81 has moved away from the valve 50 by a maximum distance. In contrast, the end portion on the side of the valve 50 (the upper side as seen in FIGS. 2A to 2C) of the plunger 81 is configured as a head portion 83 that contacts the valve 50 when the plunger 81 moves toward the valve 50. The bottom portion 82 of the plunger 81 may receive the pressure within the pressure accumulating chamber 75 and serves as a movable wall surface defining a part of the pressure accumulating chamber 75.

In this way, the plunger 81 can move toward and away from the valve 50 according to the pressure of the supply fuel in the pressure accumulating chamber 75 mentioned above. For example, as described below, when the pressure of the supply fuel in the pressure accumulation chamber 75 becomes equal to or more than a predetermined level, the plunger 81 moves toward the valve 50 to contact the valve 50, and, due to the pressure of the supply fuel in the pressure accumulating chamber 75, the plunger 81 biases the valve 50 to move in a direction away from the seat 40. The outer diameter of the plunger 81 is set to a size not preventing the plunger 81 from moving toward and away from the valve 50 and not forming any unnecessary gap between it and the inner diameter of the accommodation chamber 76.

The pressure control device 10A of the first example described above can operate as follows. That is, the opening/closing control of the valve 50 of the pressure control device 10A of the first example is effected through control between the action force of the spring load of the biasing spring 60 acting on the valve 50 in a direction for seating on the seat 40, the action force applied by the diaphragm 30 (valve opening device) acting on the valve 50 in a direction for separating the valve 50 from the seat 40, and the action force applied by the pressure load application device 70.

More specifically, when the operation of the fuel pump 6 is stopped through stopping, for example, of an automobile engine, the pressure of the supply fuel in the fuel storage chamber 12 is maintained at a normal pressure. As shown in FIG. 2A, when the pressure of the supply fuel in the fuel storage chamber 12 is a normal pressure, the valve 50 is seated on the seat 40, with the outflow port 22*a* being closed. In the case of such a normal pressure, the flow rate of the supply fuel fed to the pressure accumulating chamber 75 is controlled through pressure control of the control valve 91, and the pressure in the pressure accumulating chamber 75 does not exceed a predetermined pressure. As a result, as shown in FIG. 2A, the plunger 81 is spaced apart from the valve 50 by the maxim distance.

In a case where, for example, an automobile engine, operates at a high rotational speed, and the fuel pump 6 feeds fuel under high pressure, the pressure of the supply fuel in the fuel storage chamber 12 becomes to be a high pressure, which exceeds the predetermined pressure. Then, the valve 50 is separated from the seat 40 by the pressure of the supply fuel in the fuel storage chamber 12, and the outflow port 22*a* is brought into the first outflow-port-open state, in which the outflow port 22*a* is open. In this high pressure state in which the pressure of the supply fuel exceeds the predetermined pressure, the flow rate of the supply fuel fed to the pressure accumulating chamber 75 is controlled by the control valve 91, so that the pressure in the pressure accumulating chamber 75 does not become higher than the predetermined pressure. As a result, as shown in FIG. 2B, the plunger 81 is situated at a position where it is spaced apart from the valve 50 by the maximum distance.

In a case where, for example, an automobile engine operates at a low rotational speed, and the fuel pump 6 fees fuel under low pressure, the pressure of the supply fuel in the fuel storage chamber 12 becomes to be a low pressure, which is lower than the predetermined pressure (see FIG. 2C). When the supply fuel in the fuel storage chamber 12 is in a low pressure state, the outflow port 22*a* is brought into the second outflow-port-open state in which the outflow port 22*a* is open. That is, in the low pressure state, in which the pressure of the supply fuel is less than the predetermined pressure, the flow rate of the supply fuel fed to the pressure accumulating chamber 75 is increased through control of the control valve 91, so that the pressure in the pressure accumulating chamber 75 becomes higher than the predetermined pressure. Then, the plunger 81 moves toward the valve 50 and acts on the valve 50 so as to separate it from the seat 40. Thus, the valve 50 is separated from the seat 40 by the pressure load application device 70, so that the outflow port 22*a* is brought to the second outflow-port-open state, in which the outflow port 22*a* is open.

According to the pressure control device 10A of the first example described above, it is possible to achieve the following advantages.

That is, according to the pressure control device 10A of the first embodiment, in order to close the outflow port 22*a* for making it impossible for the supply fuel from flowing out of the outflow port 22*a*, the valve 50 can be seated on the seat 40 to stop the outflow port 22*a* solely by the biasing force of the biasing spring 60. As a result, as the biasing spring 60, it is possible to use a spring having a larger biasing force as compared with the prior art, making it possible to cause the valve 50 to be firmly seated on the seat 40. Thus, even in the state in which the operation of the fuel pump 6 has been stopped, it is possible to maintain the pressure of the fuel in the fuel supply path leading to the engine in a high pressure state.

Further, according to the pressure control device 10A of the first example, the pressure load application device 70 is equipped with the pressure accumulating chamber 75 for exerting a pressure load to the valve 50, so that, unlike the case of the supply fuel stored in the fuel storage chamber 12, the fuel accumulated in the pressure accumulating chamber 75 can exert a pressure load to the valve 50 while the fuel being maintained at a predetermined pressure level without causing outflow. As a result, the pressure load built up by the pressure load application device 70 to be applied to the valve 50 can maintained in stable. Thus, it is possible, for example, to reduce the pressure for building up this pressure load, i.e., the pump load of the fuel pump 6, etc., and to reduce the energy consumed by the fuel pump 6 (fuel consumption). That is, it is possible to reduce the general fuel consumption to thereby achieve an improvement in terms of fuel consumption.

Further, according to the pressure control device 10A of the first example, the pressure load application device 70 is provided with the plunger 81 exerting an action force to the valve 50, and the pressure within the pressure accumulating chamber 75 exerts a pressure load to the valve 50 via the plunger 81, so that whether the action force due to the pressure load application device 70 is necessary or unnecessary, it is possible to cause the pressure accumulated in the pressure accumulating chamber 75 to be applied to the valve 50 without causing leakage of the fuel. As a result, even if, for example, the action force due to the pressure load application device 70 is not necessary, due to the incorporation of the plunger 81, it is possible to minimize the leakage of pressure from the pressure accumulating chamber 75.

Further, according to the pressure control device 10A of the first example described above, the pressure inside the pressure accumulating chamber 75 is obtained through pressurization by the fuel pump 6, so that, in accumulating pressure in the pressure accumulating chamber 75, there is no need to separately provide a pressurization pump. As a result, it is possible to reduce the number of pressurization pumps and to eventually reduce the fuel consumption.

SECOND EXAMPLE

Next, a pressure control device 10B according to a second example, which is a modification of the first example described above, will be described with reference to FIG. 3. Regarding the pressure control device 10B of the second example, its description will center on the differences from the pressure control device 10A of the first example, and portions that are similar to or the same as those of the pressure control device 10A of the first example are labeled with the same reference numerals, and a description thereof will be omitted.

Figure 3:
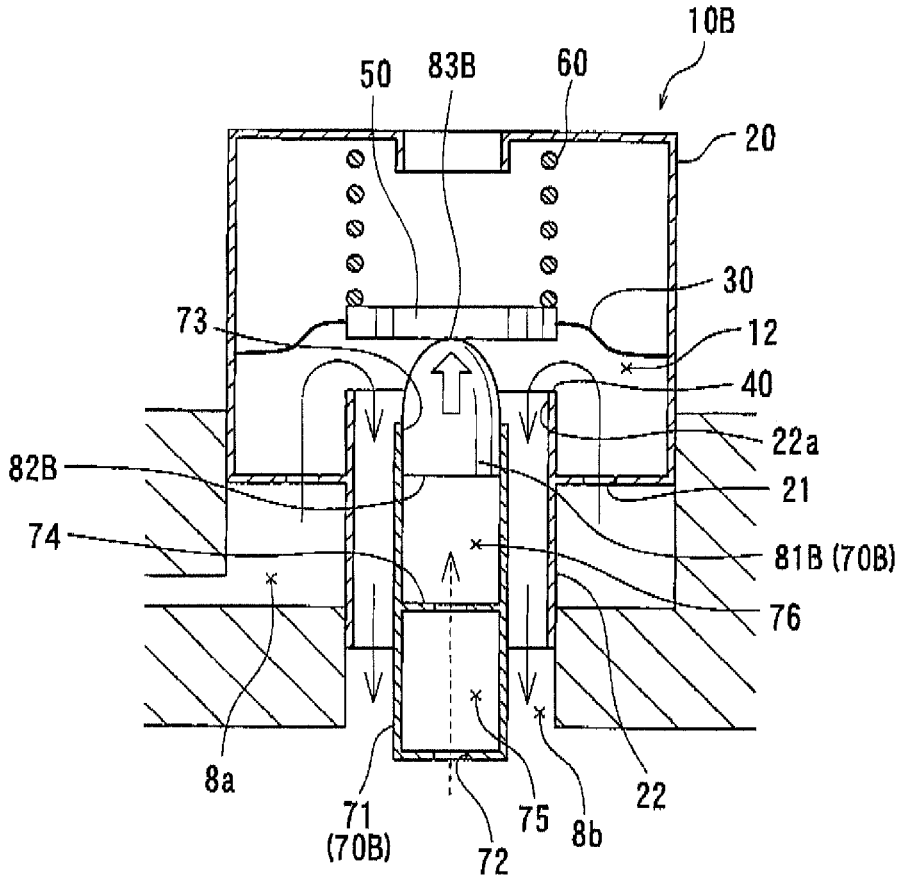
FIG. 3 is a schematic sectional view of a pressure control device according to a second embodiment.

Referring to FIG. 3, a schematic sectional view of the pressure control device 10B of the second example is shown. The pressure control device 10B of the second example shown in FIG. 3 differs from the pressure control device 10A of the first example in the construction of the plunger 81 (pressure load application device 70). More specifically, a plunger 81B (pressure load application device 70B) of the pressure control device 10B differs from the plunger 81 in that it is tapered toward a head portion 83B. More specifically, in the plunger 81B, a bottom portion 82B is formed as a flat surface, whereas the head portion 83B is formed as a pointed portion. Thus, the bottom surface 82B of the plunger 81B receiving pressure from the pressure accumulating chamber 75 has a flat circular contact area for face-to-face contact with the fuel surface (pressure receiving area), whereas the head portion 83B of the plunger 81B applying pressure to the valve 50 has a pointed contact area for point-to-point contact with the valve 50 (load application area). Thus, the area with which the plunger 81B receives pressure from the pressure accumulating chamber 75 is larger than the area with which the plunger 81B applied pressure to the valve 50.

As described above, according to the pressure control device 10B of the second example constructed as described above, the area (pressure receiving area) of the bottom portion 82B with which the plunger 81B receives pressure from the pressure accumulating chamber 75 is larger than the area (load application area) of the head portion 83B with which the plunger 81B applies pressure to the valve 50, so that, due to this difference in area, it is possible to more accurately control the movement of the plunger 81B toward and away from the valve. As a result, it is easier to perform the pressure control within the pressure accumulating chamber 75 in building up the pressure load exerted to the valve 50 by the plunger 81B. That is, when the pressure of the supply fuel in the fuel storage chamber 12 is lower than the predetermined pressure as explained in connection with the first example, it is easier to control the pressure of the supply fuel in the pressure accumulating chamber 75, which determines the position of the plunger 81B with respect to the valve 50. In addition, in the pressure control device 10B of the second embodiment, the head portion 83B of the plunger 81B contacts the valve 50 in point-to-point contact relationship therewith, so that the balancing between the valve 50 and the diaphragm 30 can be advantageously easily achieved.

THIRD EXAMPLE

Next, a pressure control device 10C according to a third example, which is also a modification of the first example, will be described with reference to FIG. 4. As in the ease of the pressure control device 10B of the second example, also regarding the pressure control device 10C of the third example, its description will center on the differences from the pressure control device 10A of the first example, and portions that are similar to or the same as those of the pressure control device 10A of the first example are labeled with the same reference numerals, and a description thereof will be omitted.

Figure 4:
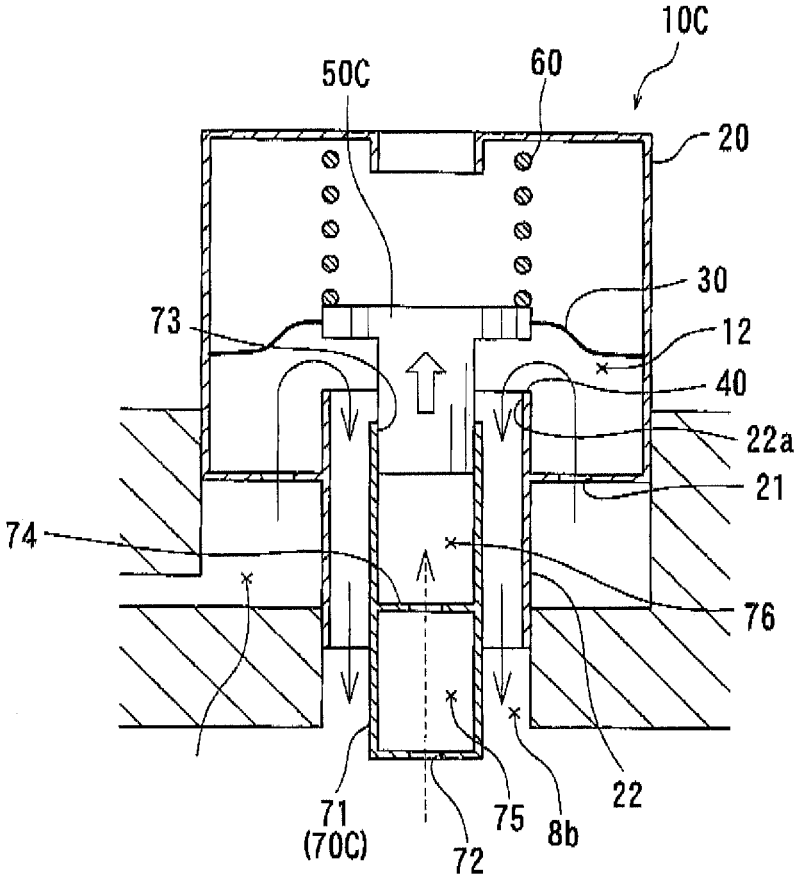
FIG. 4 is a schematic sectional view of a pressure control device according to a third embodiment.

Referring to FIG. 4, a schematic sectional view of the pressure control device 10C of the third example is shown. The pressure control device 10C of the third example shown in FIG. 4 differs from the pressure control device 10A of the first example in that there exists no plunger 81. That is, a valve 50C of the pressure control device 10C is formed by integrating the valve 50 with the plunger 81 (constituting a part of a pressure load application device 70C) of the pressure control device 10A of the first example.

As compared with the pressure control device 10A of the first example described above, in the pressure control device 10C of the third example, it is possible to reduce the number of components since no plunger 81 exists. As a result, as compared with the pressure control device 10A of the first example, the pressure control device 10C can be produced at a lower cost and more easily.

FOURTH EXAMPLE

Next, a pressure control device 10D according to a fourth example, which is also a modification of the first example, will be described with reference to FIG. 5. As in the case of the pressure control device 10B of the second example, also regarding the pressure control device 10D of the fourth embodiment, its description will center on the differences from the pressure control device 10A of the first example, and portions that are similar to or the same as those of the pressure control device 10A of the first example are labeled with the same reference numerals, and a description thereof will be omitted.

Figure 5:
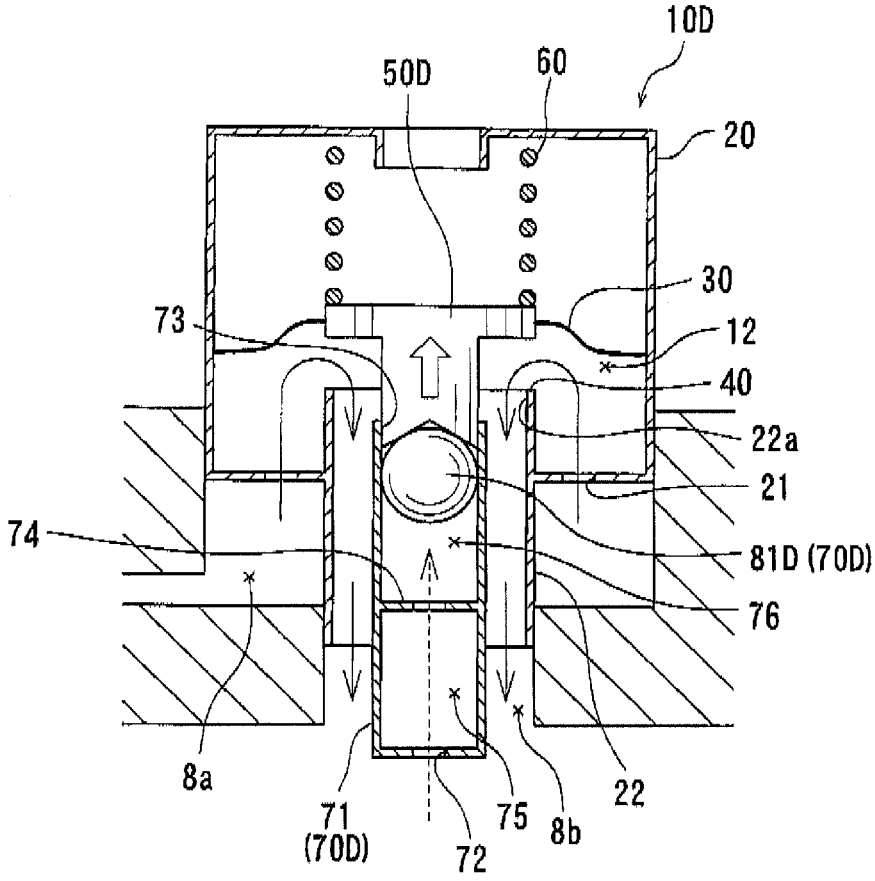
FIG. 5 is a schematic sectional view of a pressure control device according to a fourth embodiment.

Referring to FIG. 5, a schematic sectional view of the pressure control device 10D of the fourth example is shown. The pressure control device 10D of the fourth example shown in FIG. 5 differs from the pressure control device 10A of the first example in the construction of the valve 50 and of the plunger 81 (the pressure load application device 70). That is, in the pressure control device 10D of the fourth example, the plunger 81 of the pressure control device 10A of the first example is replaced with a spherical plunger ball 81D (pressure load application device 70D). In this connection, a valve 50D of the fourth example is provided with a recessed receiving portion 53 for receiving the plunger ball 81D.

Figure 6:
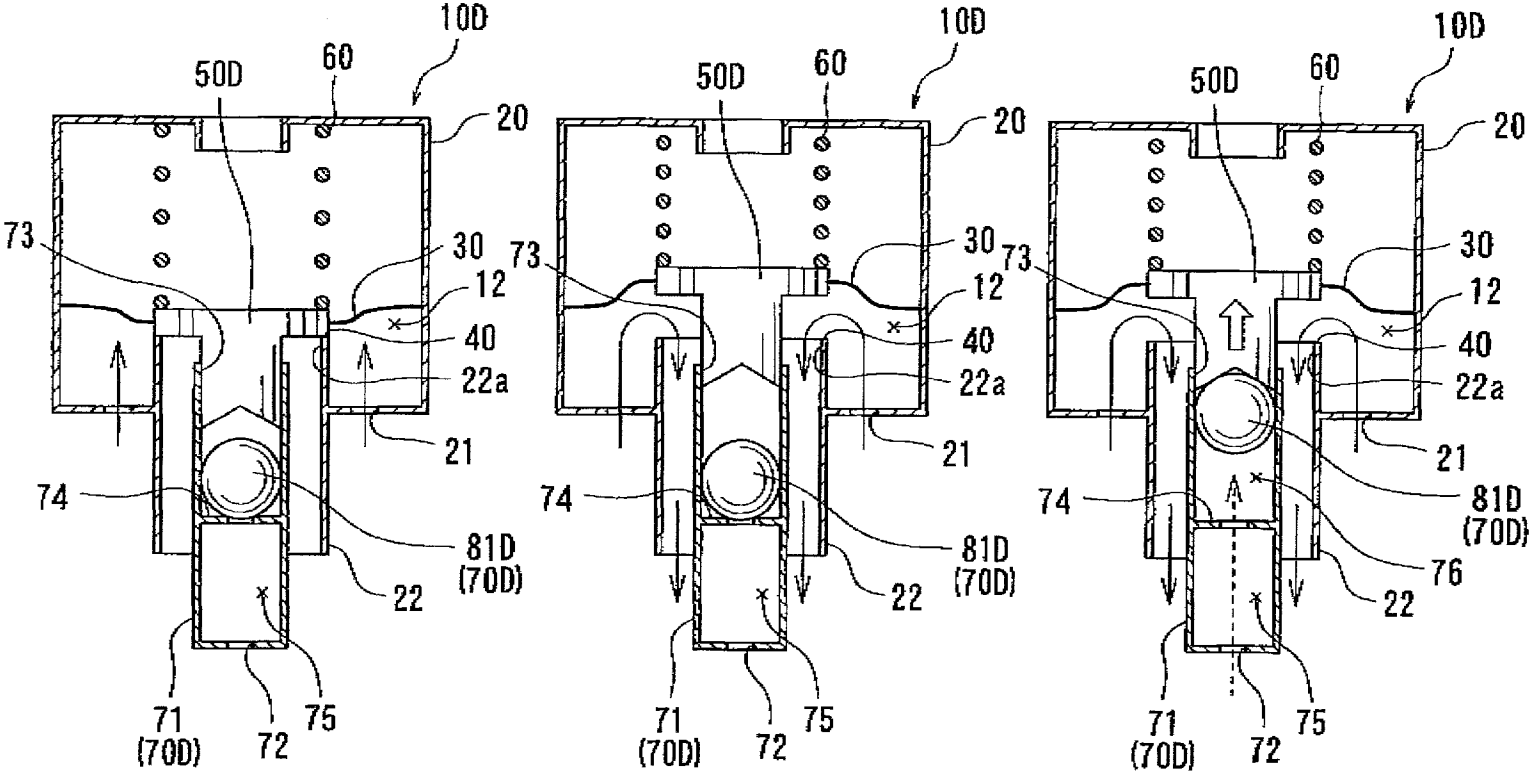
FIGS. 6A through 6C are schematic sectional views schematically illustrating the operation of the pressure control device shown in FIG. 5.

FIGS. 6A through 6C are schematic sectional views similar to FIGS. 2A through 2C and schematically illustrate the operation of the pressure control device 10D shown in FIG. 5. More specifically, FIG. 6A shows an outflow-port-closed state where the valve 50D is seated on the seat 40; FIG. 6B shows a first outflow-port-open state where the valve SOD is separated from the seat 40; and FIG. 6C shows a second outflow-port-open state where the valve 50D is separated from the seat 40. The plunger ball 81D functions in the same manner as the plunger 81 of the pressure control device 10A of the first example, so that reference is to be made to the description of the plunger 81 of the pressure control device 10A described above. While the plunger ball 81D shown in FIG. 5 is formed as a separate component from the valve 50D, it is also possible for the plunger ball 81D to be formed integrally with the valve 50D.

According to the pressure control device 10D of the fourth example, the plunger 81 of the pressure control device 10A of the first example is replaced with the spherical plunger ball 81D, and as the plunger ball 81D, it may be possible to use suitable one of spherical members that are commercially available. As a result, as compared with the pressure control device 10A of the first example, the pressure control device 10D can be produced at lower cost and more easily. Further, since the plunger ball 81D of the pressure control device 10D of the fourth example is a spherical member, it is possible to reduce a slide contact area with the inner peripheral surface of the accommodation chamber 76 during the movement toward and away from the valve 50D. As a result, as compared with the plunger 81 of the pressure control device 10A of the first example, the plunger ball 81D of the pressure control device 10D of the fourth example can be moved more smoothly.

FIFTH EXAMPLE

Next, a pressure control device 10E according to a fifth example, which is also a modification of the first example, will be described with reference to FIG. 7. As in the case of the pressure control device 10B of the second example, also regarding the pressure control device 10E of the fifth example, its description will center on the differences from the pressure control device 10A of the first embodiment, and portions that are similar to or the same as those of the pressure control device 10A of the first example are labeled with the same reference numerals, and a description thereof will be omitted.

Figure 7:
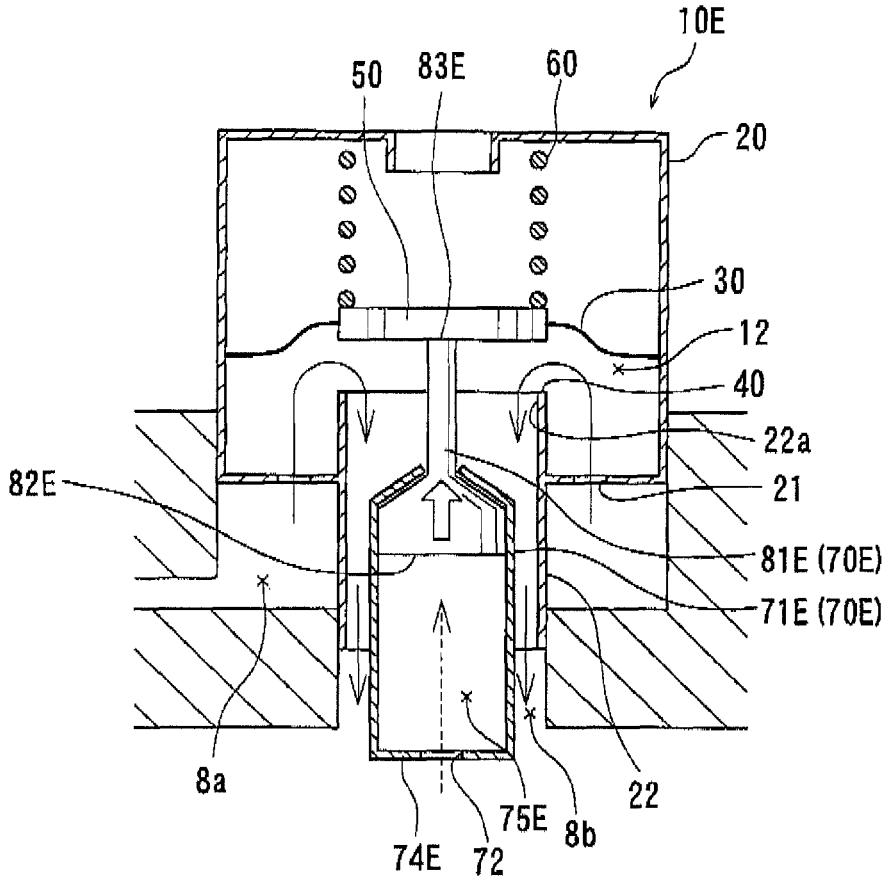
FIG. 7 is a schematic sectional view of a pressure control device according to a fifth embodiment.

Referring to FIG. 7, a schematic sectional view of a pressure control device 10E of the fifth embodiment is shown. The pressure control device 10E of the fifth example shown in FIG. 7 differs from the pressure control device 10A of the first example in the construction of the pressure accumulating tubular portion 71 and of the plunger 81 (pressure load application device 70). More specifically, a plunger 81E (pressure load application device 70E) of the pressure control device 10E is formed so as to be different in outer diameter between the side of a bottom portion 82E and the side of a head portion 83E. More specifically, portions on the sides of the bottom portion side 82 and the head portion 83E are both formed in a substantially cylindrical configuration, while the outer diameter of the portion on the side of the head portion 83E is smaller than that of the head portion 82E. Thus, as shown in FIG. 7*a*, the plunger 81E of the pressure control device 10E is of a configuration in which the head portion 83E is thinner and elongated. As a result, as in the case of the plunger 81B of the second example, also in the plunger 81E of the pressure control device 10E of the fifth example, the area (pressure receiving area) of the bottom portion 82E with which the plunger 81E receives pressure from the pressure accumulating chamber is set to be larger than the area (load application area) with which the plunger 81E applies pressure to the valve 50.

Further, in the pressure accumulating tubular portion 71E of the pressure control device 10E, there is no accommodation chamber 76 as of the pressure accumulating tubular portion 71 of the pressure control device 10A of the first example. Thus, the pressure accumulating tubular portion 71E is formed solely by the pressure accumulating chamber 75E, and a side wall of the pressure accumulating chamber 75E receiving the supply of the fuel is formed as a stopper portion 74E that can limit the separating movement of the plunger 81E. When the plunger 81E is situated at the stroke end of the separation movement from the valve 50, the bottom portion 82E of the plunger 81E contacts the stopper portion 74E, and the volume of the pressure accumulating chamber 75E is a minimum volume close to zero.

According to the pressure control device 10E of the fifth example constructed as described above, the area (pressure receiving area) of the bottom portion 82E with which the plunger 81E receives pressure from the pressure accumulating chamber 75E is set to be larger than the area (load application area) of the head portion 83E with which the plunger 81E applies pressure to the valve 50, so that, as in the pressure control device 10B of the second example, it is easier to perform pressure control of the pressure accumulating chamber 75E in building up the pressure load exerted to the valve 50 by the plunger 81E. Further, in the pressure control device 10E of the fifth example, the area (load application area) of the head portion 83E with which the plunger 81E applies pressure to the valve 50 is set to be small, so that it is possible to secure a large pressure receiving area of the diaphragm 30 and of the valve 50 when the pressure of the supply fuel stored in the fuel storage chamber 12 is applied to the diaphragm 30 and the valve 50. As a result, the pressure of the supply fuel stored in the fuel storage chamber 12 can be easily received, making it possible to achieve enhancement in sensitivity to changes in the pressure of the supply fuel. Further, since the pressure accumulating tubular portion 71E is formed solely by the pressure accumulating chamber 75E, it is possible to eliminate difficulties during manufacturing of the system and to achieve reduction in size.

SIXTH EXAMPLE

Next, a pressure control device 10F according to a sixth example, which is also a modification of the first example, will be described with reference to FIG. 8. More specifically, the pressure control device 10F of the sixth example is a modification of the pressure control device 10E of the fifth example. Thus, the following description will center on the differences from the pressure control device 10E of the fifth example, and as in the case of the pressure control device 10E of the fifth example, portions that are similar to or the same as those of the pressure control device 10A of the first embodiment are labeled with the same reference numerals, and a description thereof will be omitted.

Figure 8:
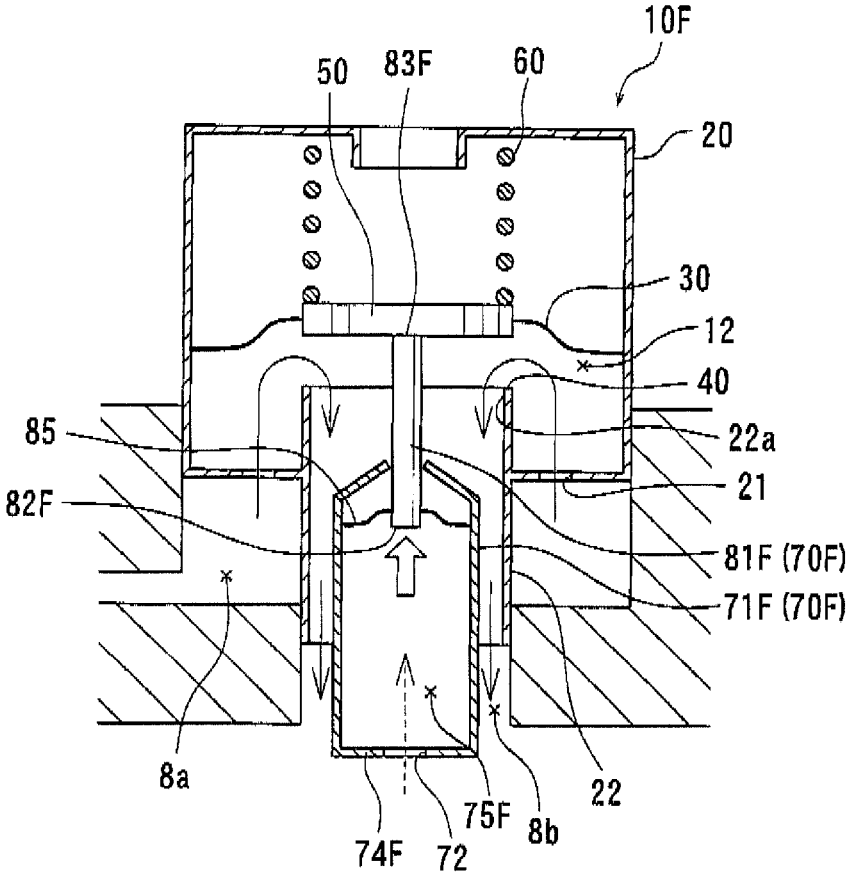
FIG. 8 is a schematic sectional view of a pressure control device according to a sixth embodiment.

Referring to FIG. 8, a schematic sectional view of the pressure control device 10F of the sixth example is shown. In the pressure control device 10F of the sixth example shown in FIG. 8, the construction of the plunger 81E (pressure load application device 70E) of the pressure control device 10E of the fifth example is modified. More specifically, in a plunger 81F (pressure load application device 70F) of the pressure control device 10F of the sixth example, the portion on the side of the bottom portion 82E of the plunger 81E of the pressure control device 10E of the fifth example is replaced with a rubber diaphragm 85. That is, the plunger 81F of the sixth example is formed in a substantially cylindrical thin and elongated configuration as if it is formed only by the head portion 83E of the plunger 81E of the fifth example. A bottom portion 82F of the plunger 81F is provided with the rubber diaphragm 85. As in the case of the diaphragm 30 connected to the outer periphery of the valve 50, the rubber diaphragm 85 is formed of by a thin resin plate that can flex under pressure. The outer peripheral edge of the rubber diaphragm 85 is connected to the inner wall surface of the pressure accumulating tubular portion 71F, and the inner peripheral edge of the diaphragm 85 is connected to the outer periphery of the bottom portion 82F of the plunger 81F. The rubber diaphragm 85 divides the interior of the pressure accumulating tubular portion 71F, and a pressure accumulating chamber 75F is formed inside the pressure accumulating tubular portion 71F through the division of the interior of the pressure accumulating tubular portion 71F.

According to the pressure control device 10F of the sixth example constructed as described above, the area (pressure receiving area) of the plunger 81F receiving pressure from the pressure accumulating chamber 75F is set to be larger than the area (load application area) of the head portion 83F with which the plunger 81F applies pressure to the valve 50, so that, as in the pressure control device 10B of the second example described above, it is easier to perform the pressure control of the pressure accumulating chamber 75F in building up the pressure load exerted to the valve 50 by the plunger 81F. Further, the pressure of the pressure accumulating chamber 75F is received by the rubber diaphragm 85, so that, in receiving the pressure accumulated in the pressure accumulating chamber 75F and exerting an action force to the valve 50, it is possible to perfectly prevent leakage of the pressure accumulated in the pressure accumulating chamber 75F. As a result, the pressure load to be applied to the valve 50 can be build up without loss, and eventually, it is possible to reduce the pump load of the fuel pump 6.

SEVENTH EXAMPLE

Next, a pressure control device 10G according to a seventh example, which is a modification of the first example, will be described with reference to FIG. 9. Regarding the pressure control device 10G of the seventh example, its description will center on the differences from the pressure control device 10A of the first example, and portions that are similar to or the same as those of the pressure control device 10A of the first example are labeled with the same reference numerals, and a description thereof will be omitted.

Figure 9:
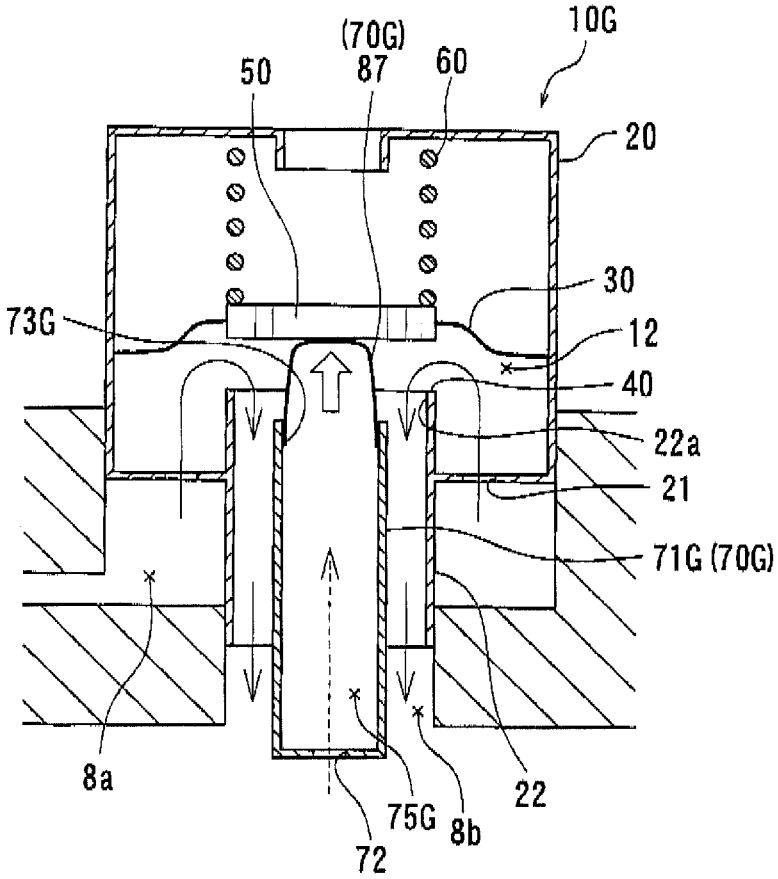
FIG. 9 is a schematic sectional view of a pressure control device according to a seventh embodiment.

Referring to FIG. 9, a schematic sectional view of the pressure control device 10G of the seventh example is shown. The pressure control device 10G of the seventh example shown in FIG. 9 differs from the pressure control device 10A of the first example in the construction of the pressure accumulating tubular portion 71 (pressure load application device 70) and of the plunger 81 (pressure load application device 70). More specifically, in the pressure accumulating tubular portion 71G (pressure load application device 70G), there exists no accommodating chamber 76 as in the pressure accumulating tubular portion 71 of the pressure control device 10A of the first example. In this example, the pressure accumulating tubular portion 71G is formed in a simple substantially cylindrical tubular configuration. Thus, the pressure accumulating tubular portion 71G is formed solely with a pressure accumulating chamber 75G. Further, an expandable member 87 (pressure load application device 70G) is attached to close an opening 73G on the side of the valve 50 of the pressure accumulating tubular portion 71G. The expandable member 87 is a member functioning like the plunger 81 of the pressure control device 10A of the first example. The expandable member 87 is formed by a thin-walled resin material substantially in a form of a bag, which is expandable like a balloon according to the inner pressure. More specifically, the expandable member 87 is formed of a thin-walled soft resin material like the rubber diaphragm and is shaped into a substantially bag shape. Thus, as shown in FIG. 9, the expandable member 87 expands (or contracts) according to the pressure within the pressure accumulating chamber 75G. In the case where the expandable member 87 expands, the pressure accumulating chamber 75G itself expands to act on the valve 50 for exerting a pressure load to the valve 50. Then, as shown in FIG. 9, the valve 50 is separated from the seat 40 to open the outflow port 22*a*.

According to the pressure control device 10G of the seventh embodiment constructed as described above, because there is provided the expandable member 87, the pressure accumulating chamber 75G can be enlarged to a magnitude large enough for acting on the valve 50, and the pressure accumulating chamber 75G itself can exert an action force to the valve 50. That is, there is no need to provide a separate member other than the pressure accumulating member 75G.

As a result, when an action force due to the pressure accumulated in the pressure accumulating chamber 75G is applied to the valve 50, it is possible to perfectly prevent leakage of the pressure accumulated in the pressure accumulating chamber 75G. That is, in building up the pressure load to be applied to the valve 50 as described above, it is possible to avoid loss of load and eventually to effectively reduce the pump load of the pressurization pump. Further, as can be seen from FIG. 9, it is possible to select a simple substantially cylindrical configuration for the pressure accumulating tubular portion 71G, thereby facilitating the production of the system.

EIGHTH EXAMPLE

Next, a pressure control device 10H according to an eighth example, which is also a modification of the first example, will be described with reference to FIG. 10. More specifically, the pressure control device 10H of the eighth example is a modification of the pressure control device 10G of the seventh example. Thus, the following description will center on the differences from the pressure control device 10G of the seventh example. As in the case of the pressure control device 10G of the seventh example, portions that are similar to or the same as those of the pressure control device 10A of the first embodiment are labeled with the same reference numerals, and a description thereof will be omitted.

Figure 10:
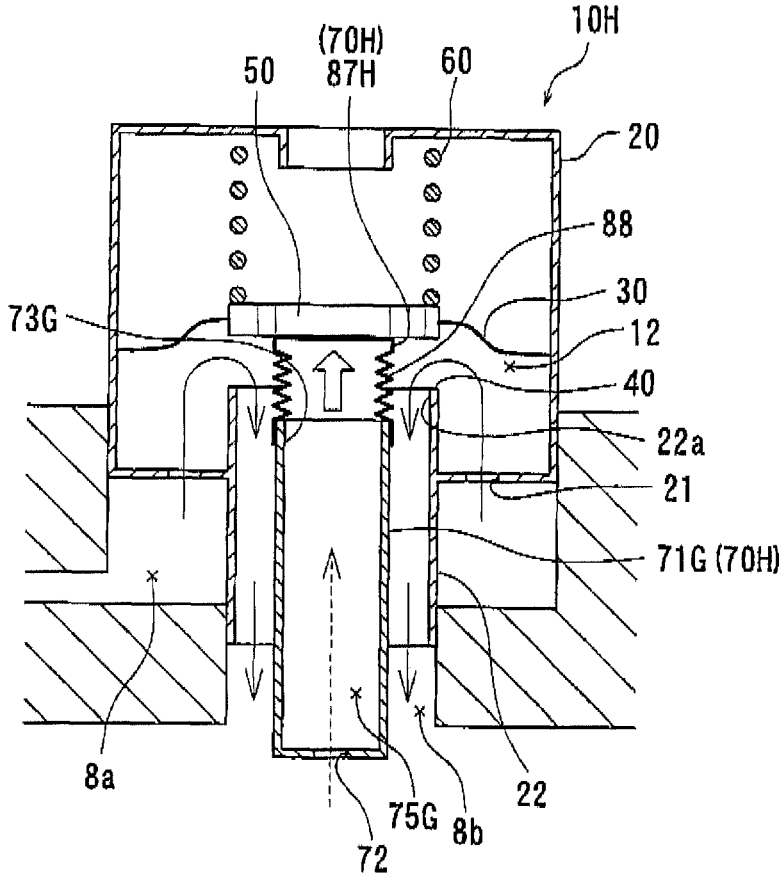
FIG. 10 is a schematic sectional view of a pressure control device according to an eighth embodiment.

Referring to FIG. 10, a schematic sectional view of the pressure control device 10H of the eighth example is shown. In the pressure control device 10H of the eighth example shown in FIG. 10, the construction of the expandable member 87 (pressure load application device 70G) of the pressure control device 10H of the seventh example is modified. More specifically, an expandable member 87H (pressure load application device 70H) of the eighth example is formed to have a bellows portion 88 which can expand and contract in the same direction as the direction in which it moves toward and away from the valve 50. The bellows portion 88 serves as an expandable/contractible portion. That is, while the expandable member 87H is the same as the expandable member 87 of the pressure control device 10G of the seventh embodiment in that it is formed of a thin-walled resin material having a substantially bag-shape, it differs therefrom in that the bellows portion 88 expands when the expandable member 87 expands according to the inner pressure. That is, in the expandable member 87H, only the bellow portion 88 expands at the time of expansion, and therefore, as a material of the expandable member 87H, it is possible to select a harder resin material than that for the expandable member 87 of the seventh embodiment.

According to the pressure control device 10H of the eighth example constructed as described above, due to the provision of the expandable member 87H, it is possible to attain the same advantages as those of the pressure control device 10G of the seventh example described above. Further, according to the pressure control device 10H of the eighth example, a wider selection range for the resin material is achieved. Further, it is possible to match the expanding/contracting direction at the time of expansion/contraction of the expandable member 87H with the direction in which the movement toward and away from the valve 50 is effected, thus making it possible to attain further stability at the time of expansion or contraction.

NINTH EXAMPLE

Next, a pressure control device 10I according to a ninth example, which is also a modification of the first example, will be described with reference to FIG. 11. Regarding the pressure control device 10I of the ninth embodiment, its description will center on the differences from the pressure control device 10A of the first embodiment, and portions that are similar to or the same as those of the pressure control device 10A of the first example are labeled with the same reference numerals, and a description thereof will be omitted.

Figure 11:
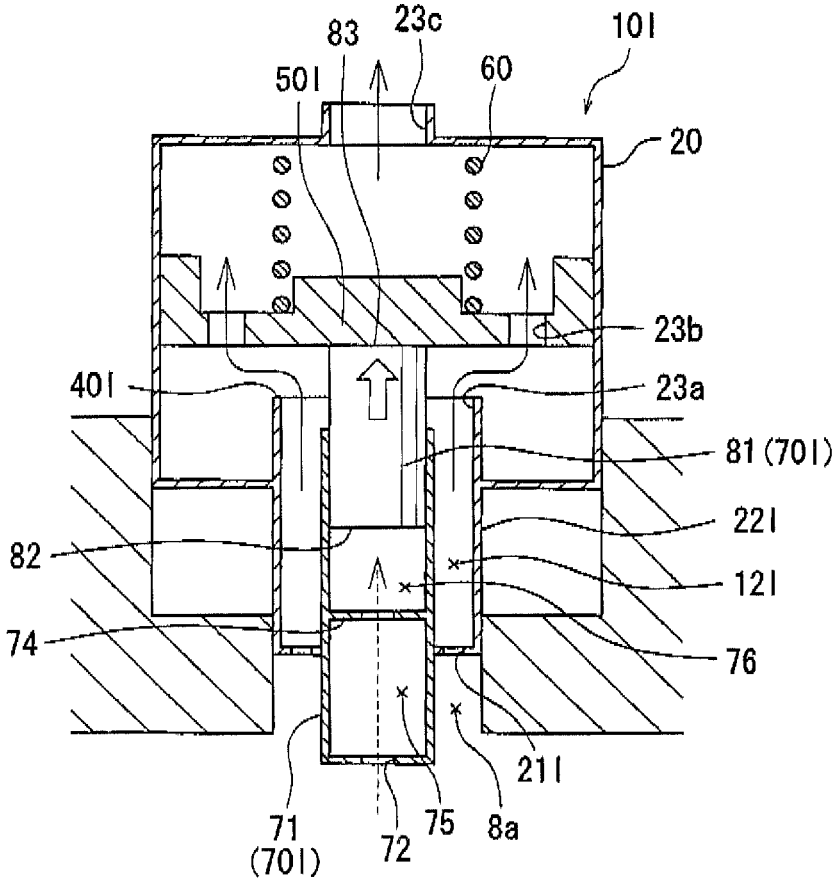
FIG. 11 is a schematic sectional view of a pressure control device according to a ninth embodiment.

Referring to FIG. 11, a schematic sectional view of the pressure control device 10I of the ninth example is shown. The pressure control device 10I of the ninth example shown in FIG. 11 differs from the pressure control device 10A of the first example in that the supply fuel flows along an I-shaped path. More specifically, in the pressure control device 10I of the ninth example, the arrangement of the inflow ports 21, the outflow port 22*a*, and the discharge port 22*b*, and the configuration of the valve 50 are different from those of the pressure control device 10A of the first example.

More specifically, similar to the pressure control device 10A of the first example, in the pressure control device 10I of the ninth example, a pressure load application device 70I is provided in the central portion of the housing 20, and a tubular portion 22I is provided around it. Here, a portion at one end of the tubular portion 22I on the outer end side of the housing 20, i.e., an axially downward end of the tubular portion 22I as viewed in FIG. 11, is formed with an inflow ports 21I communicating with the supply fuel path 8*a* for supplying a part of the supply fuel that has been pressurized and filtered. And, the other end of the tubular portion 22I on the inner end side of the housing 20, i.e., an axially upper end of the tubular portion 22I, is formed as an outflow port 23*a* that can be closed by a valve 50I. Thus, the interior of the tubular portion 22I is formed as a fuel storage chamber 12I. As a result, in the pressure control device 10I of the ninth example, the valve 50I itself serves as a valve opening device, The open end edge of the outflow port 23*a* is formed as a seat 40I where the valve 50I is to be seated. On the other hand, the valve 50I is provided with passage holes 23*b* that are disposed around a portion of the valve 50I which is seated on the seat 40I. When the supply fuel flows out of the outflow port 23*b*, the passage holes 23*b* allow the supply fuel to pass therethrough toward the side of the biasing spring 60 where the discharge port 23*c* is provided. That is, when the valve 50I is seated on the seat 40I, the outflow port 23*a* is closed (outflow port closed state), making it impossible for the supply fuel stored in the fuel storage chamber 12I to flow out of the outflow port 23*a*. In contrast, when the valve 50I is separated from the seat 40I, the outflow port 23*a* is opened (outflow port open state), and the supply fuel stored in the fuel storage chamber 12I flows out of the outflow port 23*a* and passes through the passage holes 23*b* before being discharged through the discharge port 23*c*.

According to the pressure control device 10I of the ninth embodiment described above, the supply fuel can flow along an I-shaped path, so that the pressure control device 10I can be incorporated into an existing supply fuel path to provide a so-called in-line type pressure control device. That is, the pressure control device 10I of the ninth example is advantageous in that it can be adapted to an arrangement that requires the piping structure to be taken into account.

TENTH EXAMPLE

Next, a pressure control device 10J according to a tenth embodiment, which is also a modification of the first example, will be described with reference to FIGS. 12 and 13. Regarding the pressure control device 10J of the tenth example, its description will center on the differences from the pressure control device 10A of the first example, and portions that are similar to or the same as those of the pressure control device 10A of the first example are labeled with the same reference numerals, and a description thereof will be omitted.

Figure 12:
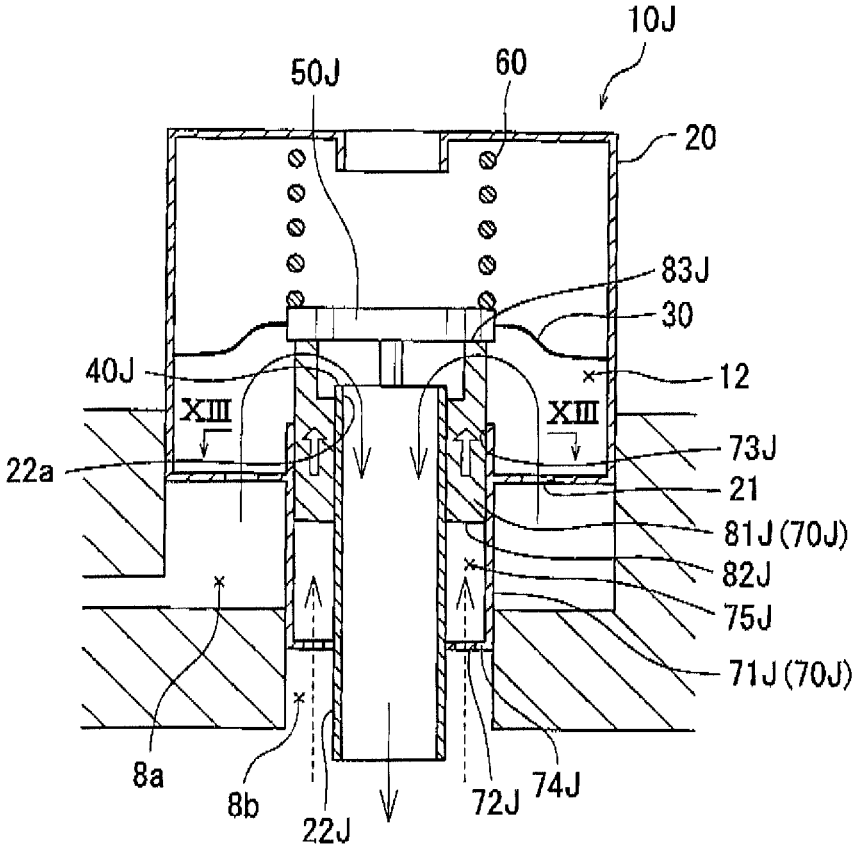
FIG. 12 is a schematic sectional view of a pressure control device according to a tenth embodiment.

Referring to FIG. 12, a schematic sectional view of the pressure control device 10J of the tenth example is shown. FIG. 13 is a schematic sectional view taken along line XIII-XIII in FIG. 12. The pressure control device 10J of the tenth example shown in FIG. 12 differs from the pressure control device 10A of the first example in the construction of the outflow port 22*a*, the valve 50, and the pressure load application device 70. In the pressure control device 10A of the first example described above, the tubular portion 22 serving as the outflow pipe is arranged on the outer peripheral side, whereas the pressure load application device 70 is arranged on the inner peripheral side. In contrast, as shown in FIGS. 12 and 13, in the pressure control device 10J of the tenth example, a tubular portion 22J serving as an outflow pipe is arranged on the inner peripheral side, whereas a pressure load application device 70J is arranged on the outer peripheral side. That is, a pressure accumulating tubular portion 71J is arranged so as to enclose the outer periphery of the tubular portion 22J. Here, one end of the pressure accumulating tubular portion 71J on the outer end side of the housing 20 has a supply side opening 72J, and the other end of the pressure accumulating tubular portion 71J has a valve side opening 73J, with the interior of the pressure accumulating tubular portion 71J being formed as a pressure accumulating chamber 75J. A seat 40J on which a valve 50J is to be seated is formed at the open end edge of the outflow port 22*a* adjacent to the fuel storage chamber 12.

Figure 13:
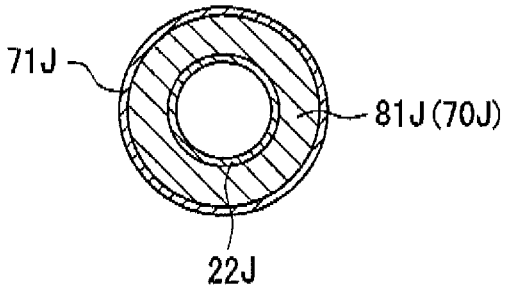
FIG. 13 is a schematic sectional view taken along the arrow line XIII-XIII of FIG. 12.

As also shown in FIG. 13, a plunger 81J is formed to have a hollow cylindrical configuration that is annular in cross sectional. The plunger 81J is equipped with a bottom portion 82J facing the pressure accumulating chamber 75J, and head portions 83J facing the valve 50J. Reference numeral 74J indicates a stopper portion of the plunger 81J. Here, as shown in FIG. 12, the head portions 83J of the plunger 81J are formed at suitable intervals in the circumferential direction. That is, when the valve 50J is separated from the seat 40J, the supply fuel stored in the fuel storage chamber 12 flows toward the outflow port 22*a* from between the head portions 83J (provided at suitable intervals) of the plunger 81J before flowing out to the exterior. This construction for allowing the supply fuel stored in the fuel storage chamber 12 to flow into the outflow port 22*a* when the valve 50J is separated from the seat 40J is not necessarily provided on the side of the plunger 81J (on the side of the head portion 83J) but may be provided on the side of the valve 50J.

According to the pressure control device 10J of the tenth example, as shown in FIG. 13, the pressure receiving area with which the bottom portion 82J of the plunger 81J receives pressure from the pressure accumulating chamber 75J can be set to be larger, due to its provision in the outer periphery, as compared with the pressure receiving area with which the bottom portion 82 of the plunger 81 of the first example receives pressure. As a result, it is possible to enhance the movement sensitivity of the plunger 81J with changes in the pressure of the supply fuel.

POSSIBLE MODIFICATIONS OF EXAMPLES

The above examples may be modified in various ways. For example, in the above-described examples, the pressure load application unit of the preset invention assumes the form of the plunger 81 or various forms that can function as a plunger. However, this should not be construed restrictively; it is possible to select some other construction as appropriate so long as it has, apart from the function of the above-mentioned valve opening unit, a function to build up a pressure load to be applied to the valve in a direction opposite to the direction of the spring load of the biasing spring that biases the valve to be seated on the seat.

Further, in the above-described examples, the pressure due to the pressurization by the fuel pump 6 is utilized as the pressure of the supply fuel fed to the pressure accumulating chamber 75. However, as the pressure of the pressure accumulating chamber, it is possible to employ some other appropriate control pressure, for example, a pressure obtained through pressurization by a pressurization pump of an appropriate control pressure mechanism.

What is claimed is:

1. A pressure control device for controlling a pressure of fuel supplied from a fuel tank to an engine via a fuel pump, comprising:

a fuel storage chamber capable of storing fuel pressurized by the fuel pump;

a valve seat provided at an outflow port of the fuel storage chamber, from which the fuel stored in the fuel storage chamber outflows;

a valve movable in a first direction toward the valve seat and a second direction away from the valve seat, wherein the valve can close the outflow port when the valve is seated on the valve seat, and the valve can open the outflow port when the valve is positioned away from the valve seat;

a biasing spring applying a first force to the valve in the first direction;

a valve opening device applying a second force to the valve in the second direction based on a pressure of the fuel stored in the fuel storage chamber; and a pressure load applying device applying a third force to the valve in the second direction;

wherein a pressure of the fuel supplied to the engine is controlled based on the relationship between the first, second and third forces; and wherein the pressure load applying device is arranged on a same side as the fuel storage chamber with respect to the valve, so that the third force of the pressure load applying device is applied only in the second direction.

2. The pressure control device as in claim 1, wherein the pressure load applying device comprises a pressure accumulating chamber that can accumulate a pressure for application to the valve.

3. The pressure control device as in claim 1, wherein the pressure load applying device further comprises a plunger capable acting on the valve, and the pressure accumulated within the pressure accumulating chamber is applied to the valve via the plunger.

4. The pressure control device as in claim 3, further comprising a plunger accommodating chamber movably accommodating the plunger, wherein the plunger accommodating chamber communicates with the pressure accumulating chamber, so that the pressure of the pressure accumulating chamber is applied to the plunger via the plunger accommodating chamber.

5. The pressure control device as in claim 3, wherein the plunger has a contact area for contacting the valve and a pressure receiving area for receiving the pressure of the pressure accumulating chamber, and wherein the pressure receiving area is larger than the contact area.

6. The pressure control device as in claim 3, wherein the plunger is integrally formed with the valve.

7. The pressure control device as in claim 3, wherein the plunger comprises a ball plunger.

8. The pressure control device as in claim 3, wherein the plunger is movably received within a tubular portion defining therein the pressure accumulation chamber.

9. The pressure control device as in claim 8, wherein the plunger is slidably received within the tubular portion, and a portion on the side of the plunger of the valve is also slidably received within the tubular portion.

10. The pressure control device as in claim 8, wherein the plunger is movably supported within the tubular portion via a diaphragm separating the pressure accumulation chamber from the other space within the tubular portion.

11. The pressure control device as in claim 2, wherein the pressure accumulating chamber includes an expandable portion that can expand by the pressure accumulated within the pressure accumulating chamber for applying the third force to the valve.

12. The pressure control device as in claim 11, wherein the expandable portion comprises a resilient member fitted to an open end of the pressure accumulating chamber for closing the open end.

13. The pressure control device as in claim 11, wherein the expandable portion comprises a bellows fitted between the valve and an open end of the pressure accumulating chamber opposed to the valve.

14. The pressure control device as in claim 2, wherein the pressure accumulating chamber accumulates a pressure of the fuel pressurized by the fuel pump.

15. The pressure control device as in claim 14, further comprising a control valve capable of controlling the pressure of the fuel supplied to the pressure accumulating chamber from the fuel pump.

16. The pressure control device as in claim 1, wherein the first, second and third forces are determined such that:

(a) when a pressure within the fuel storage chamber is lower than a first predetermined pressure, the valve is seated on the valve seat by the first force, so that the fuel within the fuel storage chamber does not outflow from the fuel storage chamber;

(b) when the pressure within the fuel storage chamber is equal to or higher than the first predetermined pressure, the valve is positioned away from the valve seat by the second force against the first force; and (c) when the pressure within the fuel storage chamber is a second predetermined pressure lower than the first predetermined pressure, the third force can be applied to the valve, so that the valve is positioned away from the valve seat by the sum of the second force and the third force against the first force.

17. A pressure control device for controlling a pressure of fuel supplied from a fuel tank to an engine via a fuel pump, comprising:

a valve device provided in a path of the fuel from the fuel pump to the engine and comprising a valve and a spring, the valve being movable in an opening direction and a closing direction for permitting and preventing flow of the fuel from the fuel pump to the engine, respectively, and the spring applying a first force to the valve in the closing direction;

a first force-applying device operable to apply a second force to the valve in the opening direction depending on the pressure of the fuel supplied from the fuel pump; and a second force-applying device operable to apply a third force to the valve in the opening direction independently of the second force applied by the first force-applying device; and wherein the second force-applying device is arranged on a same side as the first force-applying device, so that the third force of the second force-applying device is applied only in the opening direction.

18. The pressure control device as in claim 17, wherein:

the second force-applying device comprises a pressure accumulation chamber that can accumulates the pressure of the fuel supplied from the fuel pump.

19. The pressure control device as in claim 18, wherein:

the second force-applying device further comprises a pressure control valve provided between the pressure accumulation chamber and the fuel pump.

20. The pressure control device as in claim 18, wherein the first force-applying device comprises a diaphragm connected to the valve and receiving the pressure of the fuel from the fuel pump.

* * * * *